US006606755B1

(12) United States Patent
Robinson et al.

(10) Patent No.: US 6,606,755 B1
(45) Date of Patent: Aug. 19, 2003

(54) ELECTRONICALLY TIMED TOOTHBRUSH SYSTEM

(75) Inventors: Darnell Robinson, Rochester Hills, MI (US); Herb Fisher, Milford, MI (US)

(73) Assignee: American Applied Technology, Rochester Hills, MI (US)

( * ) Notice: Subject to any disclaimer, the term of this patent is extended or adjusted under 35 U.S.C. 154(b) by 0 days.

(21) Appl. No.: 09/578,023

(22) Filed: May 24, 2000

Related U.S. Application Data

(60) Provisional application No. 60/135,691, filed on May 24, 1999.

(51) Int. Cl.[7] ..... A47L 1/00; A46B 9/04

(52) U.S. Cl. ..... 15/105; 15/167.1; 15/176.1; 368/108

(58) Field of Search ..... 15/167.1, 105, 15/22.1; 368/108, 109

(56) References Cited

U.S. PATENT DOCUMENTS

| | | | | | |
|---|---|---|---|---|---|
| 4,450,599 | A | | 5/1984 | Scheller et al. | 15/22 |
| 4,698,869 | A | | 10/1987 | Mierau et al. | 15/22 |
| 4,788,734 | A | | 12/1988 | Bauer | 15/105 |
| 5,544,382 | A | * | 8/1996 | Giuliani et al. | 12/22.1 |
| 5,561,881 | A | | 10/1996 | Klinger et al. | 15/22.1 |
| 5,930,858 | A | | 8/1999 | Jung | 15/22.1 |
| 5,943,723 | A | * | 8/1999 | Hilfinger et al. | 15/105 |
| 6,000,083 | A | * | 12/1999 | Blaustein et al. | 15/22.1 |
| 6,029,303 | A | * | 2/2000 | Dewan | 15/105 |
| 6,029,304 | A | * | 2/2000 | Hulke et al. | 15/105 |
| 6,202,242 | B1 | * | 3/2001 | Salmon et al. | 15/105 |

OTHER PUBLICATIONS

Braun, Inc. brochure entitled Braun Oral–B Plaque Remover, pp. 8–9; publication date unknown.

* cited by examiner

*Primary Examiner*—Robert J. Warden, Sr.
*Assistant Examiner*—Laura C Cole
(74) *Attorney, Agent, or Firm*—Dykema Gossett PLLC

(57) ABSTRACT

A toothbrush is provided having a light source for signaling when a recommended brushing time interval has started and ended. In particular, the toothbrush includes a handle portion having a translucent portion configured to allow the transmission of light therefrom around substantially the entire circumference of the toothbrush. The toothbrush further includes a tip portion attached to the handle portion having a plurality of bristles extending therefrom. The tip portion is detachable from the handle portion. The toothbrush further includes a light emitting diode disposed within the handle portion proximate to the translucent portion. Finally, the toothbrush includes a control circuit disposed within the handle portion electrically connected to the light emitting diode.

18 Claims, 2 Drawing Sheets

ELECTRONICALLY TIMED TOOTHBRUSH SYSTEM

This application claims the benefit of U.S. Provisional Application No. 60/135,691 filed May 24, 1999.

FIELD OF INVENTION

This invention relates to a toothbrush, and, in particular, to a toothbrush that utilizes a light source for signaling when a recommended brushing time interval has started and ended.

BACKGROUND OF THE INVENTION

It is well know that plaque and bacteria adhering to teeth make the teeth more susceptible to tooth decay. Dentists generally recommend that toothbrush users brush their teeth for at least two minutes to adequately remove the plaque. However, many toothbrush users do not pay close attention to the brushing time duration to ensure that they have brushed for the recommended brushing time interval (e.g., approximately two minutes). Accordingly, visually signaling users at the start and the end of the recommended brushing time interval would allow them to brush for the desired amount of time without having to monitor the time using a watch or a clock. Further, since many users would brush for the recommended time if they were aware of the starting and ending time, additional plaque would be removed as compared with variable brushing time durations.

Known toothbrushes have utilized a light source to indicate when the recommended brushing time interval has started and ended. However, the known toothbrushes utilize light sources that do not illuminate the toothbrush 360° around the circumference of the toothbrush. Accordingly, a user brushing their teeth may not see the light source unless take the toothbrush out of their mouth, rotate the toothbrush, and look at the status of the light source. Thus, the user may not brush for the recommended brushing time interval since they have to periodically check the status of the light source during the recommended brushing time interval. Another limitation of known toothbrushes is that as soon as the toothbrush is activated, a timer in the toothbrush starts counting the time over the recommended brushing time interval. Since, the known toothbrushes do not take into account the time required to apply toothpaste to the toothbrush, the user may not brush for the recommended brushing time interval if they activate the toothbrush prior to applying the toothpaste to the toothbrush.

There is thus a need for a toothbrush and a method that minimizes or reduces one or more of the above mentioned deficiencies.

SUMMARY OF THE INVENTION

The present invention provides a toothbrush that utilizes a light source for signaling when a recommended brushing time interval has started and ended. The inventive toothbrush includes a handle portion having a translucent portion configured to allow the transmission of light therefrom around substantially the entire circumference of the toothbrush. The toothbrush further includes a tip portion attached to the handle portion having a plurality of bristles extending therefrom. The tip portion and the handle portion are detachable from one another. The toothbrush may further include a light source disposed within the handle portion proximate to the translucent portion. The light source may illuminate the entire translucent portion so that light emitted from the translucent portion can be seen 360° around the toothbrush. Finally, the toothbrush may include a control circuit disposed within the handle portion configured to control the light source.

A method for controlling a light source disposed in a translucent region of a toothbrush for indicating when a recommended brushing time interval has started and ended, includes a step of sensing when an activation switch on the toothbrush is set to a first state for a first predetermined time interval. The inventive method further includes a step of iteratively switching the light source off and on for a second predetermined time interval after the first predetermined time interval has elapsed. The inventive method further includes a step of switching the light source on for a third predetermined time interval after the second predetermined time interval has elapsed. The inventive method further includes a step of iteratively switching the light source off and on for a fourth predetermined time interval after the third predetermined time interval has elapsed. The recommended brushing time interval comprises the sum of the third and fourth predetermined time intervals. Finally, the inventive method includes a step of switching the light source off.

A toothbrush and method in accordance with the present invention represents a significant improvement over conventional toothbrushes and methods. In particular, the inventive toothbrush utilizes a translucent portion and a light source disposed therein to emit light 360° around the circumference of the toothbrush. Accordingly, a user can easily see when the recommended brushing time interval has elapsed without having to periodically take the toothbrush out of their mouth to check the status of the light source. Further, the inventive method provides an extra time interval prior to the recommended brushing time interval to allow a user sufficient time to apply toothpaste to the toothbrush.

These and other features and advantages of this invention will become apparent to one skilled in the art from the following detailed description and the accompanying drawings illustrating the features of this invention by way of example.

DETAILED DESCRIPTION OF THE PREFERRED EMBODIMENT

Figure 1A:
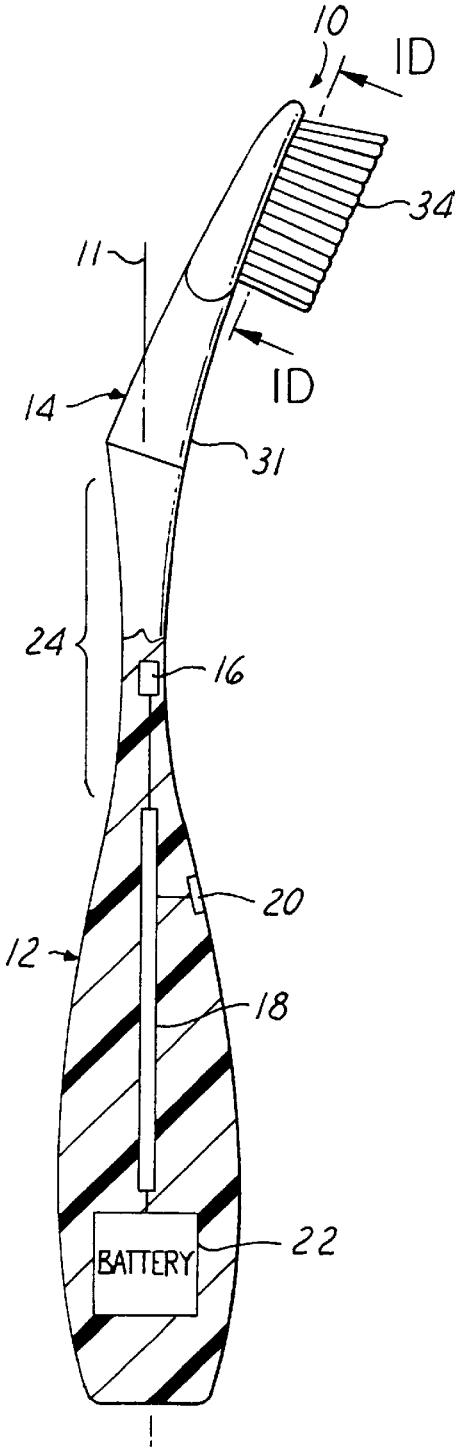
FIGS. 1A–1D are combination schematic and block diagrams of a toothbrush in accordance with the present invention.

Referring now to the drawings wherein like reference numerals are used to identify identical components in the various views, FIG. 1A illustrates a toothbrush 10 in accordance with the present invention. Toothbrush 10 utilizes a light source 16 for signaling when a recommended brushing time interval has started and ended. In particular, toothbrush 10 emits light 360° around the circumference of the toothbrush 10. Toothbrush 10 may be centered about an axis 11 and includes a handle portion 12, a tip portion 14, a light source 16, a control circuit 18, a switch 20, and a battery 22.

Figure 1B:
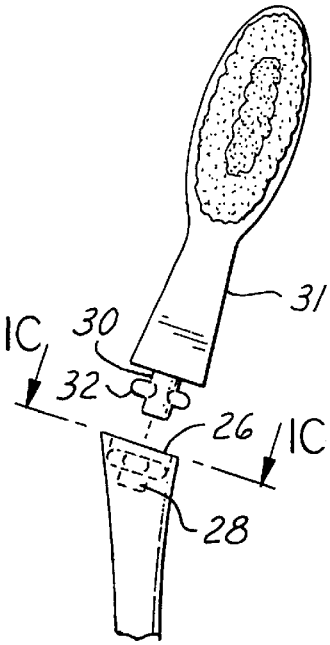
Figure 1C:
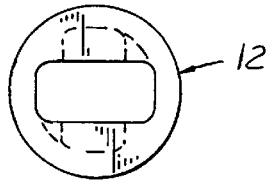

Handle portion 12 is designed to allow a user to grasp toothbrush 10 and may be constructed of a translucent material such as polypropylene or other similar translucent material. Handle portion 12 includes an integral translucent portion 24 disposed proximate to a first end 26 of portion 12. In the illustrated embodiment, portion 24 is generally cylindrically shaped to allow the transmission of light therefrom around substantially the entire circumference of toothbrush 10. In other words, portion 24 allows light from light source 16 to be radially emitted from portion 24 360° around toothbrush 10. However, portion 24 may be configured in alternate embodiments to allow light to be emitted around only a portion of the circumferential distance of toothbrush 10. Further, translucent portion 24 may be disposed in alternate locations on portion 12 or on tip portion 14. Referring to FIGS. 1B and 1C, portion 12 may further include a female engagement slot 28 configured to receive a male engagement portion 30 of tip portion 14.

Referring to FIG. 1B, tip portion 14 is detachably connected to handle portion 12 to allow for the periodic replacement of portion 14. Thus, portion 14 may be replaced approximately every three months as recommended by dentists. Portion 14 may be constructed from a translucent material such as polypropylene or other like material and may include a central body portion 31, male engagement portion 30 extending from portion 31, projections 32 extending generally radially from portion 30, and bristles 34 attached to portion 31. Tip portion 14 may be fixedly attached to handle portion 12 by inserting engagement portion 30 into engagement slot 28 and turning portion 14 in a first rotational direction relative to portion 12. Similarly, tip portion 14 may be detached from handle portion 12 by turning portion 14 in a second rotational direction (opposite the first rotational direction) relative to portion 12 and removing engagement portion 30 from engagement slot 28.

Figure 1D:
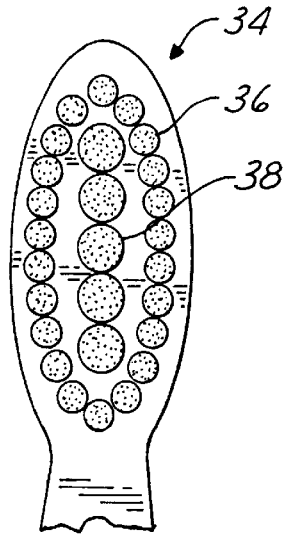

Referring to FIG. 1D, bristles 34 may include a plurality of medium tension bristles 38 disposed centrally on body portion 31 and a plurality of soft tension bristles 36 disposed around the plurality of medium tension bristles 38. The soft tension bristles 36 protect a user's gums from being damaged while brushing, and, the medium tension bristles 38 allow plaque to be effectively removed from teeth when the teeth are brushed for the recommended brushing time interval.

Referring to FIG. 1A, light source 16 is provided to emit light from toothbrush 10 to visually signal when a recommended brushing time interval has started and ended. Light source 16 may comprise a light emitting diode (LED) or other similar device and is electrically connected to control circuit 18 which controls light source 16.

Figure 2:
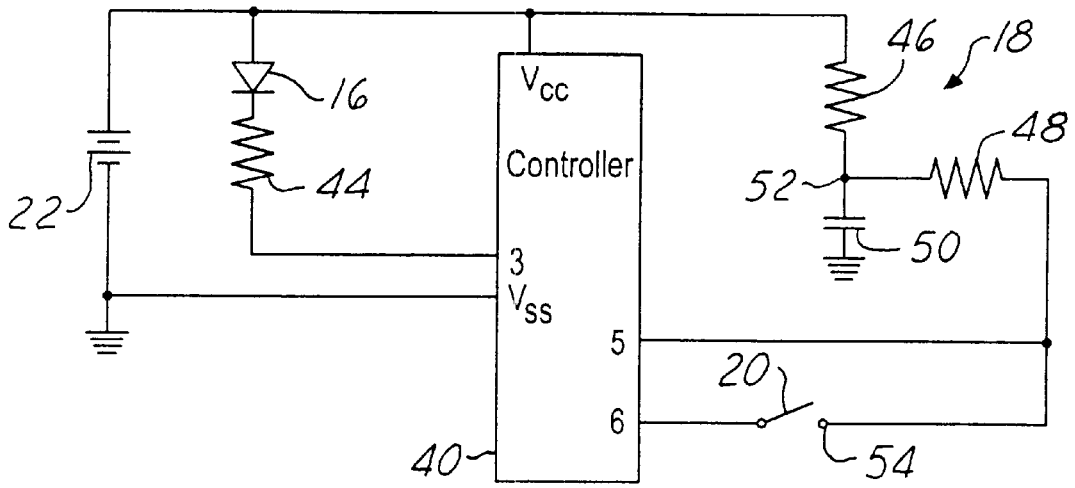
FIG. 2 is an electrical schematic of a control circuit for controlling a light source in the toothbrush shown in FIGS. 1A–1D.

Referring to FIGS. 1A and 2, control circuit 18 may be disposed within handle portion 12 of toothbrush 10 and include a conventional controller 40 disposed on a printed circuit board (not shown). Circuit 18 may further include light source 16, switch 20, battery 22, resisters 44, 46, 48, and a capacitor 50. Battery 22 provides an operating voltage for controller 40 across pins $V_{cc}$ and $V_{ss}$ of controller 40. LED 16 and resister 44 are electrically connected in series between the positive terminal of battery 22 and pin 3 of controller 40. Resister 46 and capacitor 50 are electrically connected in series between the positive terminal of battery 22 and the ground terminal of battery 22. Resister 48 is electrically connected between a node 52 (intermediate resister 46 and capacitor 50) and pin 5 of controller 40. During the operation of circuit 18, resisters 46, 48 and capacitor 50 provide a reference voltage to pin 5 of controller 40 and to a terminal 54 of normally-open switch 20. Accordingly, when switch 20 closes, the voltage applied to pin 5 is equal to the voltage applied to pin 6. Controller 40 is programmed to sense when the voltages at pins 5 and 6 are equal to one another (indicating switch 20 is closed). Further, controller 40 initiates an inventive method 56 described hereinbelow responsive to the closing of switch 20. While implementing method 56, controller 40 switches on LED 16—which causes LED 16 to emit light—by internally grounding pin 3 which induces current to flow through LED 16 and resister 44. Similarly, controller 40 switches off LED 16—which causes LED 16 to stop emitting light—by internally setting pin 3 to a high logic level voltage.

Figure 3:
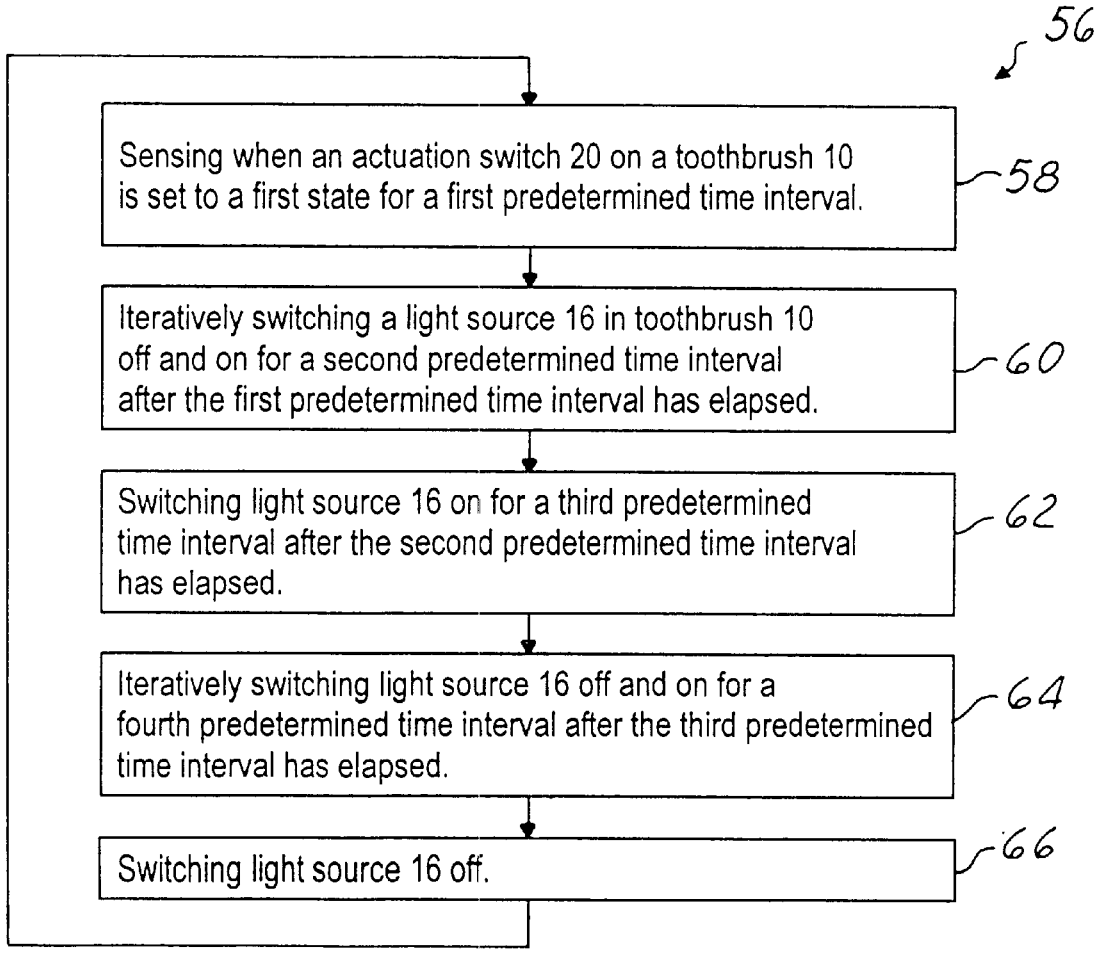
FIG. 3 is a flowchart showing a method for controlling a light source in the toothbrush shown in FIGS. 1A–1D.

Referring to FIG. 3, the method 56 for indicating when a recommended brushing time interval has started and ended is illustrated. The method 56 may be implemented using software stored in a read-only memory ROM of controller 40. The inventive method 56 may include a step 58 of sensing when switch 20 on toothbrush 10 is set to a first state (e.g., closed state) for a first predetermined time interval. As previously discussed, controller 40 determines when switch 20 is in a closed state by comparing the voltage applied to pins 5 and 6 of controller 40. When the voltage applied to pins 5 and 6 are equal, switch 20 is in the closed state. The first predetermined time interval is preferably equal to three seconds to ensure that a user has not accidentally depressed switch 20. It should be understood, however, that the first predetermined time interval may be less than or greater than three seconds.

The method 56 may further includes a step 60 of iteratively switching LED 16 in toothbrush 10 off and on for a second predetermined time interval after the first predetermined time interval has elapsed. The second predetermined time interval is preferably equal to ten seconds which provides a user sufficient time to apply toothpaste to bristles 34 of toothbrush 10.

The method 56 may further include a step 62 of switching LED 16 on for a third predetermined time interval after the second predetermined time interval has elapsed. When LED 16 is switched on, the user is visually signaled that the recommended brushing time interval has started. The third predetermined time interval is preferably one minute and forty-five seconds, although, the third predetermined time interval may vary depending upon the duration of the recommended brushing time interval.

The method 56 may further include a step 64 of iteratively switching LED 16 off and on for a fourth predetermined time interval after the third predetermined time interval has elapsed. When LED 16 is switched off and on during step 64, the user is visually signaled that the recommended brushing time interval has almost been completed. The fourth predetermined time interval is preferably fifteen seconds although the fourth predetermined time interval may vary. Further, the frequency that LED 16 is switched off and on, preferably increases over the duration of the fourth predetermined time interval. As previously discussed, the recommended brushing time interval is the sum of the third and fourth predetermined time intervals (recommended brushing time interval=third predetermined time interval+fourth predetermined time interval).

Finally, the method 56 may include a step 66 of switching LED 16 off. When LED 16 is switched off, the user is visually signaled that the recommended brushing time interval has elapsed, and thus, the user can stop brushing their teeth. It should be understood that upon completion of the inventive method 56, the user may reinitiate method 56 by depressing (closing) switch 20 again.

The toothbrush and method in accordance with the present invention represents a significant improvement over conventional toothbrushes and methods. In particular, the inventive toothbrush utilizes a translucent portion and a light source disposed therein to emit light 360° around the circumference of the toothbrush to indicate when the recommended brushing time interval has started and ended. Further, the inventive method provides an extra time interval upon actuation of the toothbrush, prior to the recommended brushing time interval, to allow a user sufficient time to apply toothpaste to the toothbrush.

While the invention has been particularly shown and described with reference to a preferred embodiment thereof, it is well understood by those skilled in the art that various changes and modifications can be made in the invention without departing from the spirit and scope of the invention.

We claim:

1. A toothbrush, comprising:

a handle portion having a translucent portion configured to allow the transmission of light therefrom;

a tip portion attached to said handle portion having a plurality of bristles extending therefrom;

a light source disposed within said handle portion proximate to said translucent portion; and, a control circuit disposed within said handle portion configured to control said light source to interactively switch said light source on and off for a second predetermined time period after a delay of a first predetermined time period and for then switching said light source back on for a third predetermined time period, and said control circuit switches said light source interactively on and off on a variable frequency for a fourth predetermined time period.

2. The toothbrush of claim 1 wherein said translucent portion is integral with said handle portion and is generally cylindrically shaped.

3. The toothbrush of claim 1 wherein said tip portion and said handle portion are detachable from one another.

4. The toothbrush of claim 1 wherein said handle portion and said tip portion are constructed of a translucent material.

5. The toothbrush of claim 4 wherein the translucent material is polypropylene.

6. The toothbrush of claim 1 wherein said plurality of bristles includes a plurality of medium tension bristles disposed centrally on said tip portion and a plurality of soft tension bristles disposed circumferentially around said plurality of medium tension bristles.

7. The toothbrush of claim 1 wherein said light source is a light emitting diode.

8. The toothbrush of claim 1 further comprising a battery disposed within said handle portion and electrically connected to said control circuit.

9. The toothbrush of claim 1 wherein said translucent portion of said handle portion is illuminated when said light source is switched on by said control circuit.

10. The toothbrush of claim 1 wherein said translucent portion is configured around substantially an entire circumference of said toothbrush.

11. The toothbrush of claim 1 wherein said frequency increases with time elapsed during said fourth predetermined time period.

12. The toothbrush of claim 1 wherein said control circuit can switch said light source off.

13. The toothbrush of claim 1 wherein said control circuit includes a software driven read only memory.

14. A toothbrush, comprising:

a handle portion having a translucent portion configured to allow the transmission of light therefrom, said translucent portion being configured around substantially an entire circumference of said toothbrush;

a tip portion attached to said handle portion having a plurality of bristles extending therefrom;

a light source disposed within said handle portion proximate to said translucent portion; and, a control circuit disposed within said handle portion configured to control said light source to interactively switch said light source on and off for a second predetermined time period after a delay of a first predetermined time period and for then switching said light source back on for a third predetermined time period.

15. The toothbrush of claim 14 wherein said control circuit switches said light source interactively on and off for a fourth predetermined time period.

16. The toothbrush of claim 15 wherein said control circuit can switch said light source off.

17. The toothbrush of claim 14 wherein a frequency that said control circuit turns said light source on and off is variable.

18. A toothbrush comprising:

a handle portion having a translucent portion disposed approximate to a first end of said handle portion and configured to allow the transmission of light therefrom;

a tip portion attached to said handle portion having a plurality of bristles extending therefrom;

a light emitting diode disposed within said handle portion approximate to said translucent portion;

a switch connected on said handle portion; and a controller disposed within said handle portion electrically connected to said light emitting diode, said controller interactively turning said light emitting diode on and off for a second predetermined time period after a delay of a first predetermined time period after said switch is activated and said controller turning said diode on for a third predetermined time period after said second predetermined time period and said controller interactively turning said diode on and off for a fourth predetermined time period after said third predetermined time period and said controller switching said diode off after said fourth predetermined time period, and wherein the frequency said controllers turns said diode on and off increases during the fourth predetermined time period.

* * * * *